US009464500B2

(12) United States Patent
Allison et al.

(10) Patent No.: US 9,464,500 B2
(45) Date of Patent: Oct. 11, 2016

(54) RAPID SWELLING AND UN-SWELLING MATERIALS IN WELL TOOLS

(75) Inventors: David B. Allison, Duncan, OK (US); Leonard Case, Duncan, OK (US); Alf Kolbjorn Sevre, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1435 days.

(21) Appl. No.: 12/870,476

(22) Filed: Aug. 27, 2010

(65) Prior Publication Data

US 2012/0048551 A1 Mar. 1, 2012

(51) Int. Cl.
*E21B 33/13* (2006.01)
*E21B 33/12* (2006.01)

(52) U.S. Cl.
CPC ..... *E21B 33/1208* (2013.01)

(58) Field of Classification Search
CPC ..... E21B 33/1208
USPC ..... 166/387, 118, 179
See application file for complete search history.

(56) References Cited

U.S. PATENT DOCUMENTS

| | | | |
|---|---|---|---|
| 2,144,026 | A | 1/1939 | Park |
| 2,814,947 | A | 12/1957 | Stegemeier et al. |
| 2,849,070 | A | 8/1958 | Maly |
| 2,945,541 | A | 7/1960 | Maly |
| 3,099,318 | A | 7/1963 | Miller et al. |
| 3,385,367 | A | 5/1968 | Kollsman |
| 3,918,523 | A | 11/1975 | Stuber |
| 4,137,970 | A | 2/1979 | Laflin et al. |
| 4,182,677 | A | 1/1980 | Bocard et al. |
| 4,240,800 | A | 12/1980 | Fischer |
| 4,375,240 | A | 3/1983 | Baugh et al. |
| 4,558,875 | A | 12/1985 | Yamaji et al. |
| 4,633,950 | A | 1/1987 | Delhommer et al. |
| 4,635,726 | A | 1/1987 | Walker |
| 4,862,967 | A | 9/1989 | Harris |
| 4,936,386 | A | 6/1990 | Colangelo |
| 5,180,704 | A | 1/1993 | Reindl et al. |
| 5,523,357 | A | 6/1996 | Peterson |
| 5,533,570 | A | 7/1996 | Streich et al. |
| 5,718,287 | A | 2/1998 | Streich et al. |
| 6,575,251 | B2 | 6/2003 | Watson et al. |

(Continued)

FOREIGN PATENT DOCUMENTS

| | | |
|---|---|---|
| GB | 2396869 A | 7/2004 |
| GB | 2406593 A | 4/2005 |

(Continued)

OTHER PUBLICATIONS

Office Action issued Dec. 19, 2011 for U.S. Appl. No. 13/197,973, 29 pages.

(Continued)

*Primary Examiner* — Nicole Coy
(74) *Attorney, Agent, or Firm* — Locke Lord LLP

(57) ABSTRACT

Rapid swelling and un-swelling materials provide for rapid actuation of well tools. A well tool can include a swellable material, with the swellable material comprising a swellable glass material. A method of actuating a well tool in a subterranean well can include contacting a swellable material of the well tool with an activating fluid in the well, thereby causing the swellable material to swell. The well tool rapidly actuates in response to contacting the swellable material with the activating fluid.

10 Claims, 4 Drawing Sheets

(56) References Cited

U.S. PATENT DOCUMENTS

| | | | | |
|---|---|---|---|---|
| 6,705,615 | B2 | 3/2004 | Milberger et al. | |
| 6,834,725 | B2 | 12/2004 | Whanger et al. | |
| 6,848,505 | B2 | 2/2005 | Richard et al. | |
| 6,938,698 | B2 | 9/2005 | Coronado | |
| 7,059,415 | B2 | 6/2006 | Bosma et al. | |
| 7,143,832 | B2 | 12/2006 | Freyer | |
| 7,219,541 | B2 | 5/2007 | DiFoggio | |
| 7,234,533 | B2 | 6/2007 | Gambier | |
| 7,240,546 | B2 | 7/2007 | DiFoggio | |
| 7,516,654 | B2 | 4/2009 | DiFoggio | |
| 7,665,537 | B2 | 2/2010 | Patel et al. | |
| 7,779,907 | B2 | 8/2010 | Wagner et al. | |
| 7,866,383 | B2 | 1/2011 | Dusterhoft et al. | |
| 8,047,928 | B2 | 11/2011 | Bittner | |
| 2004/0020662 | A1 | 2/2004 | Freyer | |
| 2004/0194971 | A1 | 10/2004 | Thomson | |
| 2004/0231861 | A1 | 11/2004 | Whanger et al. | |
| 2004/0261990 | A1 | 12/2004 | Bosma et al. | |
| 2005/0092485 | A1 | 5/2005 | Brezinski et al. | |
| 2005/0199401 | A1 | 9/2005 | Patel et al. | |
| 2007/0112242 | A1 | 5/2007 | Edmiston | |
| 2007/0246213 | A1 | 10/2007 | Hailey, Jr. | |
| 2007/0246225 | A1 | 10/2007 | Hailey, Jr. et al. | |
| 2007/0257405 | A1 | 11/2007 | Freyer | |
| 2008/0023205 | A1 | 1/2008 | Craster et al. | |
| 2008/0110626 | A1 | 5/2008 | Allison et al. | |
| 2009/0084550 | A1 | 4/2009 | Korte et al. | |
| 2009/0179383 | A1 | 7/2009 | Koloy et al. | |
| 2009/0205816 | A1* | 8/2009 | De et al. | 166/118 |
| 2009/0218107 | A1 | 9/2009 | Chauffe | |
| 2009/0229816 | A1 | 9/2009 | Lemme et al. | |
| 2010/0051294 | A1 | 3/2010 | Nutley et al. | |
| 2010/0139930 | A1 | 6/2010 | Patel et al. | |
| 2010/0155064 | A1 | 6/2010 | Nutley et al. | |
| 2010/0212883 | A1 | 8/2010 | Emerson et al. | |
| 2010/0243269 | A1 | 9/2010 | Solhaug et al. | |
| 2011/0315405 | A1 | 12/2011 | Solhaug et al. | |

FOREIGN PATENT DOCUMENTS

| | | | |
|---|---|---|---|
| GB | 2416796 | A | 2/2006 |
| GB | 2417270 | A | 2/2006 |
| GB | 2417271 | A | 2/2006 |
| GB | 2417272 | A | 2/2006 |
| GB | 2428263 | A | 1/2007 |
| GB | 2428264 | A | 1/2007 |
| JP | 04-363499 | | 12/1992 |
| JP | 09-151686 | | 6/1997 |
| JP | 2000-064764 | | 2/2000 |
| WO | 02059452 | A1 | 8/2002 |
| WO | 03008756 | A1 | 1/2003 |
| WO | 2005116394 | A1 | 12/2005 |
| WO | 2008060297 | A2 | 5/2008 |

OTHER PUBLICATIONS

International Search Report with Written Opinion issued Feb. 10, 2012 for PCT Patent Application No. PCT/US11/047802, 12 pages.
Office Action issued Mar. 15, 2011 for U.S. Appl. No. 12/410,042, 26 pages.
Office Action issued May 17, 2012 for U.S. Appl. No. 13/197,973, 9 pages.
Baker Hughes, Non-Inflatable Mechanical Isolation Packers, undated, 2 pages.
Halliburton, Swellpacker Isolation System, H07827, Sep. 2010, 3 pages.
Journal of Non-Crystalline Solids, Highly Swellable Sol-Gels Prepared by Chemical Modification of Silanol Groups Prior to Drying, vol. 351 No. 40-42 pp. 3174-3178 dated Aug. 17, 2005, 5 pages.
Produced Water Absorbers, Swelling Glass, "Osorb" and a 21st Century Materials Company, undated, 28 pages.
Swellfix UK Ltd., Swellfix DynaFORM Packer Brochure, vol. 1, dated Jan. 14, 2009, 2 pages.
Halliburton, SwellTchnology Systems, "Swellpaker System Solves Casing Challenge to Successfully Seal and Anchor North Sea Well Tieback Liner", H06750, dated May 2009, 2 pages.
Tam, Casing Annulus Packers and Accessories, dated Mar. 2005, 20 pages.
EPO Communication dated Feb. 8, 2007, containing a Letter from the Opponent dated Jan. 31, 2007, for European Patent Application No. EP 01958642.9, 2 pages.
EPO Communication of a Notice of Opposition dated Dec. 14, 2006, for European Patent Application No. EP 01958642.9, 16 pages.
International Search Report issued Nov. 13, 2001, for International Patent Application No. PCT/NO01/00275, 3 pages.
Chloroprene, Kirk-Othmer Encyclopedia of Chemical Technology, 1993, title and copyright pages and p. 70, vol. 6, John Wiley & Sons publisher, New York.
The Concise Oxford Dictionary, undated, title page and pp. 148-149, 360-361, 740-741, 7th Edition, Clarendon Press, Oxford.
European Search Report issued May 18, 2006, for European Patent Application No. EP 06075453.8, 5 pages.
International Search Report and Written Opinion issued Jun. 17, 2008, for International Patent Application Serial No. PCT/US06/60926, 6 pages.
International Search Report and written Opinion issued Feb. 21, 2007, for International Patent Application Serial No. PCT/US06/35052, 8 pages.
International Search Report and Written Opinion issued Mar. 21, 2008, for Internationai Patent Application Serial No. PCT/US07/61703, 7 pages.
EasyWell SwellPacker Cable presentation, 2006, 2 pages.
U.S. Appl. No. 12/410,042, filed Mar. 24, 2009, 38 pages.
International Preliminary Report on Patentability issued Oct. 6, 2011 for International Patent Application No. PCT/US10/027561, 6 pages.
International Preliminary Report on Patentability with Written Opinion issued Aug. 20, 2009, for International Patent Application Serial No. PCT/US07/61703, 7 pages.
Office Action issued Dec. 10, 2009, for U.S. Appl. No. 11/939,968, 27 pages.
Final Office Action issued Jun. 7, 2010, for U.S. Appl. No. 11/939,968, 17 pages.
Advisory Action issued Aug. 13, 2010, for U.S. Appl. No. 11/939,968, 3 pages.
International Search Report with Written Opinion issued Oct. 14, 2010, for International Patent Application Serial No. PCT/US10/027561, 9 pages.
Office Action issued Jan. 11, 2013 for U.S. Appl. No. 13/197,973, 11 pages.
Office Action issued Sep. 13, 2012 for U.S. Appl. No. 13/197,973, 5 pages.

* cited by examiner

RAPID SWELLING AND UN-SWELLING MATERIALS IN WELL TOOLS

BACKGROUND

This disclosure relates generally to equipment utilized and operations performed in conjunction with a subterranean well and, in an example described below, more particularly provides for rapid setting and unsetting of a swellable packer.

Swellable materials have been used in the past to perform various functions in well tools. For example, a swellable material may be used in a packer seal element to provide a packer assembly which is self-actuating downhole. When an appropriate fluid contacts the swellable material, the material swells and seals off an annulus in the well.

However, it can take many hours or even days for conventional swellable materials to swell in a well. Rig time is very expensive, and so this is a disadvantage to use of conventional swellable materials. In addition, once swollen, such materials are not generally un-swellable, or even if they could be un-swollen, this would take very long periods of time, and would be unpredictable.

Therefore, it will be appreciated that it would be desirable to provide improvements in the art of swelling and un-swelling swellable materials in subterranean wells. Such improvements could be useful for initiating actuation of packer assemblies, as well as other types of well tools.

SUMMARY

In the disclosure below, well tools and methods are provided which solve at least one problem in the art. One example is described below in which a well tool is actuated by a swellable material which rapidly swells when contacted by an activating fluid. Another example is described below in which the swellable material, once swollen, can be reliably and relatively quickly un-swollen in the well.

In one aspect, the present disclosure provides to the art a method of actuating a well tool in a subterranean well. The method can include contacting a swellable material of the well tool with an activating fluid in the well, thereby causing the swellable material to swell. The material swells, and the well tool actuates, in response to the contacting step. The swelling and/or actuating can be virtually instantaneous, or can be extended to longer periods (e.g., days, if desired).

In another aspect, this disclosure provides a well tool which comprises a swellable material. The swellable material can comprise a swellable glass material.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
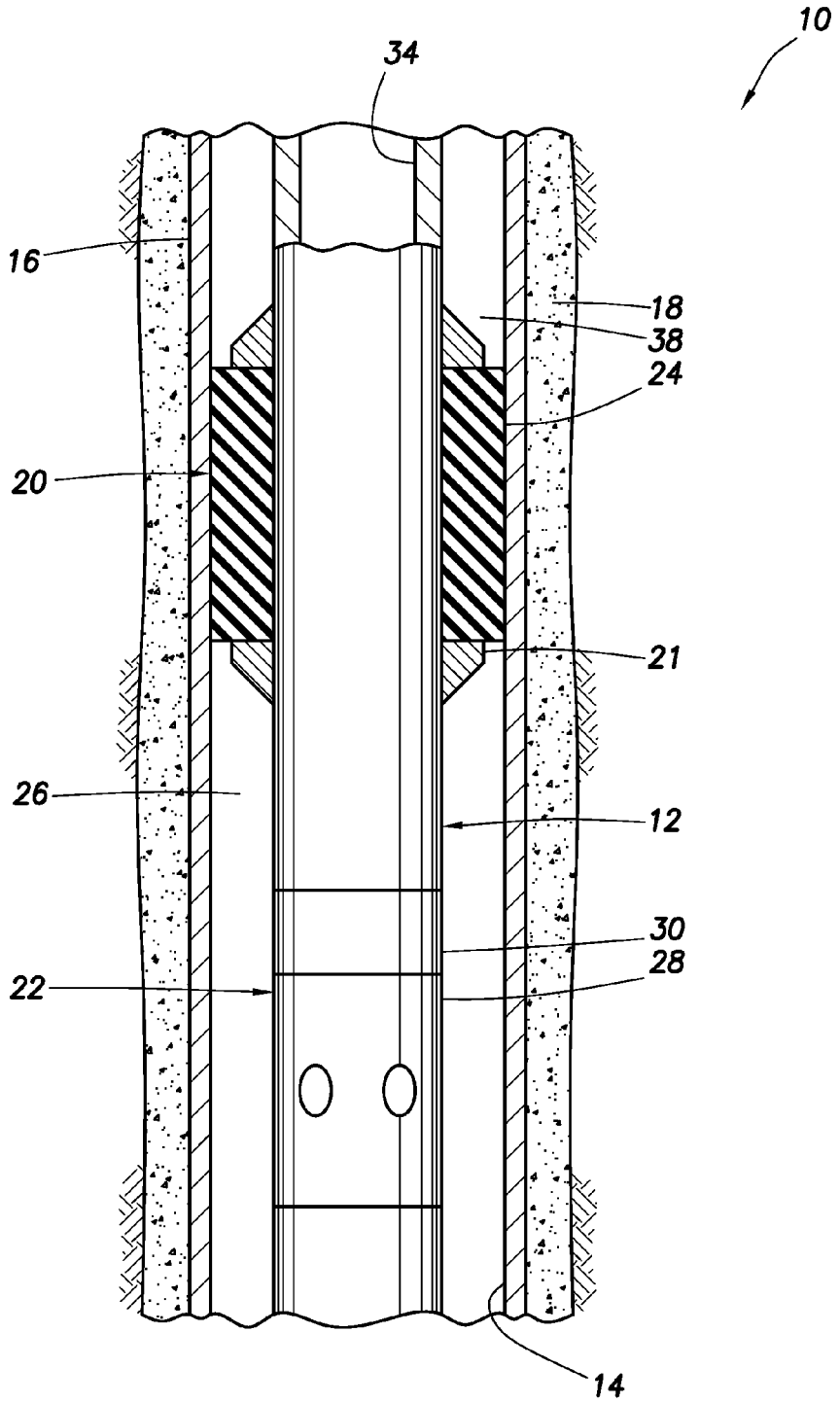
FIG. 1 is a partially cross-sectional schematic view of a well system which can embody principles of the present disclosure.

Representatively illustrated in FIG. 1 is a well system 10 and associated method which embody principles of the present disclosure. In the well system 10, a tubular string 12 is installed in a wellbore 14. In this example, the wellbore 14 is lined with casing 16 and cement 18, but the wellbore could instead be unlined or open hole in other embodiments.

The tubular string 12 includes well tools 20 and 22. The well tool 20 is depicted as comprising a packer assembly 21, and the well tool 22 is depicted as being a valve or choke assembly. However, it should be clearly understood that these well tools 20, 22 are merely representative of a variety of well tools which may incorporate principles of this disclosure.

The well tool 20 includes a swellable seal 24 for use as an annular barrier to selectively prevent flow through an annulus 26 formed between the tubular string 12 and the casing 16. Swellable materials may be used as seals in other types of well tools in keeping with the principles of this disclosure.

For example, another type of swellable seal is described in U.S. Publication No. 2007-0246213 for regulating flow through a well screen. The entire disclosure of this prior application is incorporated herein by this reference.

The well tool 22 includes a flow control device 28 (such as a valve or choke, etc.) and an actuator 30 for operating the flow control device. Swellable materials may be used in other types of actuators for operating other types of well tools.

For example, actuators using swellable materials for operating well tools are described in U.S. Publication No. 2007-0246225. The entire disclosure of this prior application is incorporated herein by this reference.

The swellable material used in the well tools 20, 22 swells when contacted by an appropriate fluid. The term "swell" and similar terms (such as "swellable") are used herein to indicate an increase in volume of a swellable material.

Typically, this increase in volume is due to incorporation of molecular components of the fluid into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded radially outward without any increase in volume of the seal material of which the seal element is made. Thus, in these conventional packers, the seal element expands outward, but does not swell.

The fluid which causes swelling of the swellable material could be water and/or hydrocarbon fluid (such as oil, gas or gas condensate). The fluid could be a gel or a semi-solid material, such as a hydrocarbon-containing wax or paraffin which melts when exposed to increased temperature in a wellbore. In this manner, swelling of the material could be delayed until the material is positioned downhole where a predetermined elevated temperature exists. The fluid could cause swelling of the swellable material due to passage of time.

Figure 2:
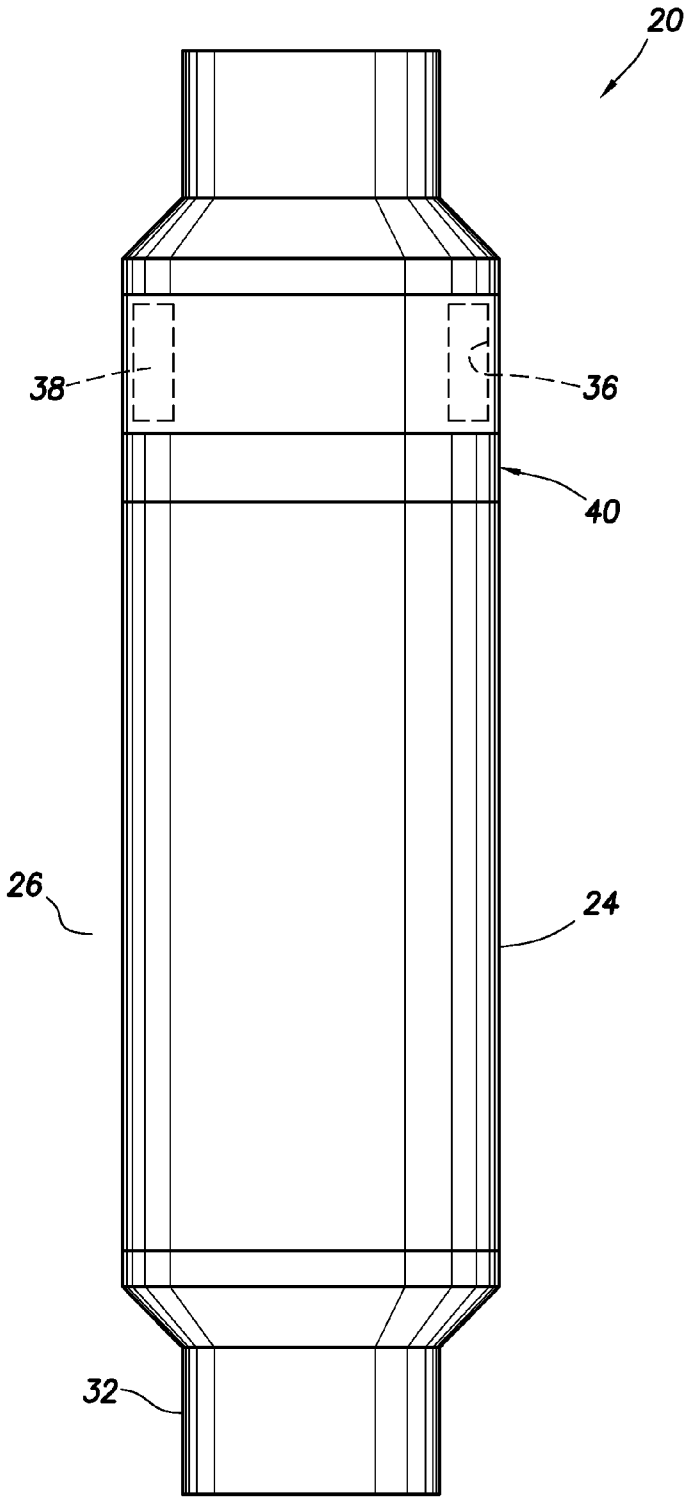
FIG. 2 is an enlarged scale schematic elevational view of a well tool which may be used in the well system of FIG. 1.

Referring additionally now to FIG. 2, an enlarged scale schematic cross-sectional view of one possible configuration of the well tool 20 is representatively illustrated. The well tool 20 is used for convenience to demonstrate how the principles of this disclosure may be beneficially incorporated into a particular well tool, but any other type of well tool may utilize the principles of this disclosure to enable swelling of a swellable material of the well tool.

As depicted in FIG. 2, the swellable seal 24 is positioned on a generally tubular mandrel 32. The swellable seal 24 could, for example, be adhesively bonded to the mandrel 32, or the swellable seal could be otherwise secured and sealed to the mandrel.

An optional flow passage 34 (not visible in FIG. 2, see FIG. 1) extends longitudinally through the mandrel 32. When the well tool 20 is interconnected as part of the tubular string 12, as in the system 10 of FIG. 1, the flow passage 34 also extends longitudinally through the tubular string, and so pressure in the flow passage can be conveniently manipulated from the surface or another remote location.

The well tool 20 also includes a reservoir 36 containing a fluid 38 which, when it contacts a swellable material 44 (not visible in FIG. 2, see FIGS. 3 & 4) of the swellable seal 24, will cause the material to swell. The reservoir 36 may take various forms, and several examples are described in more detail below.

A flow controller 40 is used to control fluid communication between the reservoir 36 and the swellable seal 24. In this manner, the fluid 38 only contacts the swellable material 44 when desired. Preferably, the flow controller 40 initially prevents the fluid 38 from contacting the swellable material 44, but permits such contact in response to a predetermined manipulation of pressure in the passage 34 (e.g., application of at least a minimum pressure in the passage).

For example, application of pressure to initiate contact between the fluid 38 and the swellable material 44 via the flow controller 40 could result in rupturing of a rupture disc. In other examples, the flow controller 40 could instead, or in addition, incorporate flow control devices which are responsive to signals transmitted via acoustic, pressure pulse, tubular string manipulation or electromagnetic telemetry from a remote location. Suitable telemetry responsive flow controllers are described as an actuator, valves and control device in copending U.S. application Ser. No. 12/353,664, filed on Jan. 14, 2009, the entire disclosure of which is incorporated herein by this reference.

A packer assembly and other well tools which can be activated on demand are described in U.S. application Ser. No. 12/410,042, filed on Mar. 24, 2009, the entire disclosure of which is incorporated herein by this reference. The well tools 20, 22 described herein can incorporate any of the features described in this prior application.

Note that the fluid 38 can be initially present in the well, could be introduced into the well (e.g., by flowing into the wellbore 14 from an earth formation, by flowing into the wellbore from the surface, etc.) or could otherwise be brought into contact with the swellable material 44. Thus, it is not necessary for the reservoir 36 or flow controller 40 to be used in keeping with the principles of this disclosure.

Figure 3:
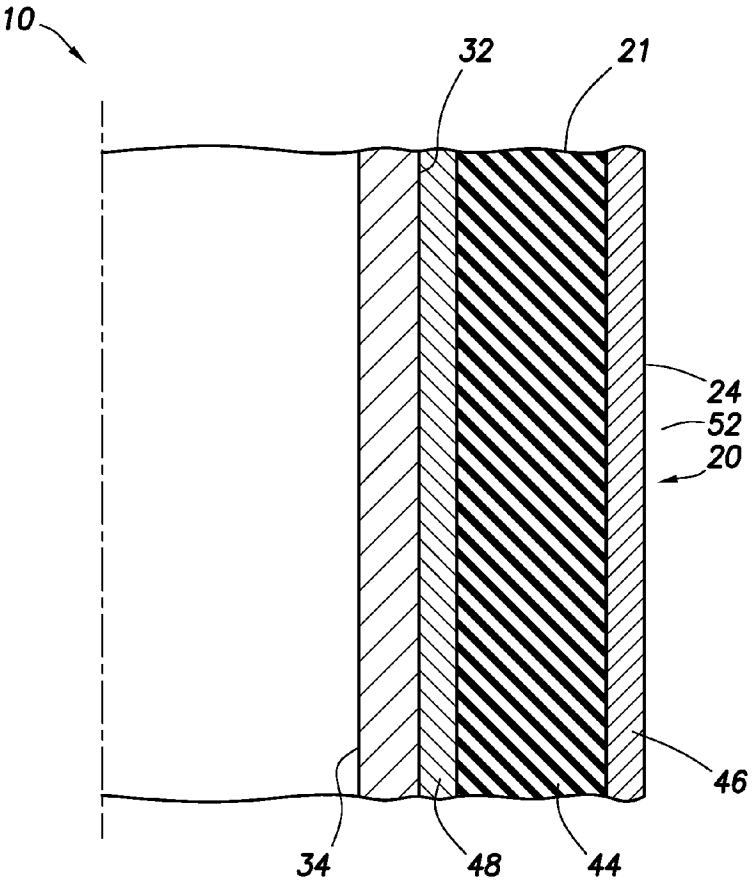
FIG. 3. is an enlarged scale schematic cross-sectional view of a portion of the well tool.

In one important novel feature of the well tools 20, 22, the rapidly swelling and unswelling swellable material 44 can be used for activating the well tools. As depicted in FIG. 3, the swellable material 44 is enclosed within an optional outer layer material 46. Another optional inner layer material 48 may be used to further isolate the swellable material 44 from well fluids.

The swellable material 44 and outer and inner layer materials 46, 48 comprise the swellable seal 24. When the flow controller 40 opens and permits fluid communication between the reservoir 36 and the swellable seal 24, the fluid 38 is allowed to contact the swellable material 44. In response, the swellable material 44 rapidly swells.

The outer and inner layers 46, 48 may also be made of a swellable material, if desired. For example, the outer and inner layers 46, 48 could be made of a conventional swellable material, or the layers could be made of a non-swellable material.

Various conventional swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

The swellable material may have a considerable portion of cavities which are compressed or collapsed at the surface condition. Then, when being placed in the well at a higher pressure, the material is expanded by the cavities filling with fluid.

This type of apparatus and method might be used where it is desired to expand the material in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable material which swells when contacted by any type of fluid may be used in keeping with the principles of this disclosure.

The outer layer 46 could be used to delay swelling of the swellable material 44. For example, the outer layer 46 could be designed to dissolve or otherwise degrade over a predetermined period of time, so that the swellable material 44 will swell at a known future time.

Thus, the outer layer 46 (and/or the inner layer 48) can initially isolate the swellable material 44 from an activating well fluid 52 and then, after a certain period of time, the layer can permit contact between the swellable material 44 and the activating fluid. This can allow the swellable seal 24 to be appropriately positioned in the well prior to the swellable material 44 being swollen in response to contact with the well fluid 52.

The outer layer 46 and/or inner layer 48 could be made of a material having a known permeability, such that the fluid 38 migrates slowly through the material at a known rate. This can delay swelling of the material 44 until a known period of time has elapsed.

Although various materials for the inner and outer layers 46, 48 have been described above, it should be clearly understood that any other materials or combinations of materials may be used, in keeping with the principles of this disclosure. Any listings of materials provided herein are not intended to be exhaustive.

If the inner and/or outer layers 46, 48 are not used, then other techniques may be provided for selectively contacting the swellable material 44 with the fluid 38. For example, the material 44 could be deployed in a well that only has water in it. Later, as hydrocarbons flow into the well from a reservoir, the hydrocarbons contact the material 44, causing it to swell.

Preferably, the swellable material 44 is a type of material which swells immediately when contacted by the appropriate fluid. For example, the swellable material 44 may swell in a matter of seconds, or even less time.

One suitable material which can be used for the swellable material 44 is a swellable glass material. A suitable swellable glass material is OSORB™ marketed by Absorbent Materials Company LLC of Wooster, Ohio USA. The OSORB™ material rapidly swells when contacted by hydrocarbon fluid.

The swellable material 44 can also be readily un-swollen by removing the activating fluid from the swellable material. Thus, the swellable seal 24, once swollen into sealing contact with the wellbore 14, can then be readily un-swollen if desired (for example, in order to conveniently retrieve the tubular string 12 from the well, etc.).

The un-swelling process can take hours or days, for example. In one possible technique, a specialized solvent is placed in contact with the material 44. The solvent extracts the hydrocarbon fluid from the material, permitting it to shrink back to its original size. Some of the solvent may replace the hydrocarbons within the material 44. The swelling and un-swelling of the material 44 can be performed multiple times and, in theory, could have an almost limitless number of cycles.

Figure 4:
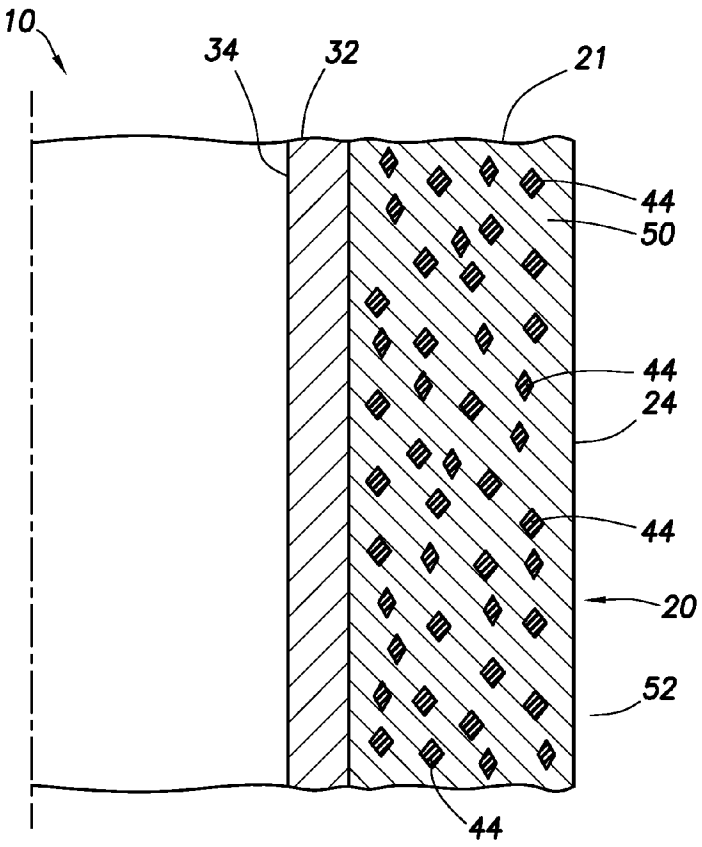
FIG. 4 is a schematic cross-sectional view of another configuration of the well tool portion.

Referring additionally now to FIG. 4, another configuration of the well tool 20 is representatively illustrated. In this configuration, the swellable material 44 is incorporated into another matrix material 50. The matrix material 50 could, for example, be a conventional swellable material.

Alternatively, or in addition, the activating fluid could have a known rate of diffusing through the matrix material 50, so that swelling of the swellable material 44 can be delayed a predetermined period of time.

Note that the swellable material 44 may also be used in the well tool 22 of FIG. 1, for example, to open and/or close the flow control device 28. The swellable material 44 can be used to activate any type of well tool (such as any of those described in U.S. Publication No. 2007-0246225).

Although several specific examples of the well tools 20, 22 are described above, in order to demonstrate a variety of ways in which the principles of this disclosure may be incorporated into a well tool, note that there exists an even wider variety of well tool configurations which can possibly utilize the disclosure principles. Furthermore, any of the features described above for one of the embodiments can be used with any of the other embodiments, so any combination of the features described above can be used in keeping with the principles of this disclosure.

For example, the swellable seal 24 can be used on casing 16 to provide or enhance a primary seal in the annulus between the casing and a surrounding borehole 42. Instantaneous (or at least very fast) swelling of the material 44 would be initiated directly after the cement 18 has been placed in the annulus, thus eliminating the necessity of waiting for the cement to harden in order to effect a seal between the casing 16 and the borehole.

Figure 5:
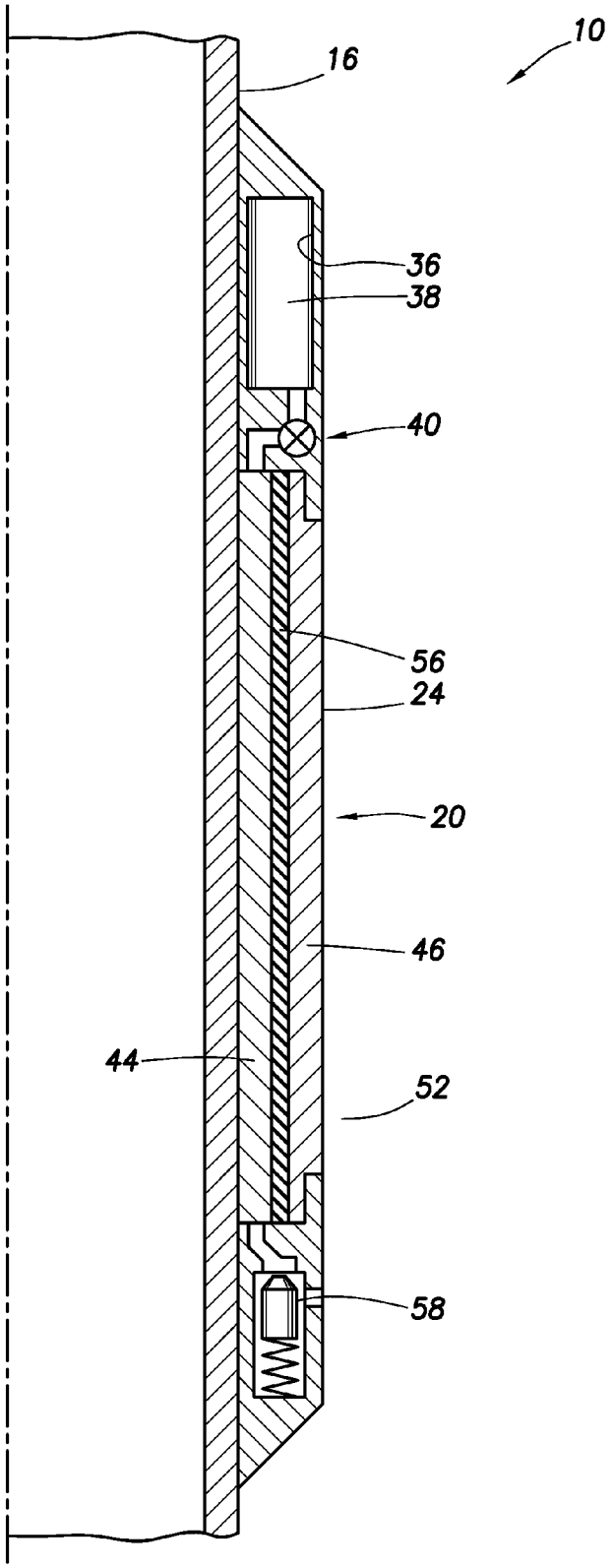
FIG. 5 is a schematic cross-sectional view of another configuration of the well tool.

Referring additionally now to FIG. 5, another configuration of the well tool 20 is representatively illustrated. In this configuration, the swellable seal 24 is positioned on the casing 16, instead of on the tubular string 12, but the swellable seal could be on the tubular string 12 or any type of mandrel, in keeping with the principles of this disclosure.

As depicted in FIG. 5, the inner layer material 48 is not used, and a barrier material 56 is positioned between the outer layer material 46 and the swellable material 44. The barrier material 56 protects the outer layer material 46 from contact with the swellable material 44 in those situations in which the swellable material 44 could damage the outer layer material.

A relief valve 58 is also provided to prevent overpressurization of the swellable material 44. It is contemplated that, in some circumstances, swelling of the swellable material 44 could generate sufficient pressure to burst the outer layer material 46, and the relief valve 58 is provided to prevent this from happening. The relief valve 58 opens to thereby vent the swellable material 44 when a predetermined pressure is reached in the swellable material.

It may now be fully appreciated that this disclosure provides several advancements to the art of actuating well tools in subterranean wells. For example, the packer assembly 21 described above can be rapidly actuated to seal off the annulus 26 by contacting the swellable material 44 with the activating fluid 38.

The swellable material 44 can then be un-swollen, for example, to unset the packer assembly 21 and permit convenient retrieval of the tubular string 12, by withdrawing the fluid 38 from the swellable material, for example, by replacing it with an appropriate solvent. The flow control device 28 can also be actuated between open and closed positions, choked and un-choked positions, etc., by using the swellable material 44 in the actuator 30. Any number of swelling and un-swelling cycles may be performed.

The above disclosure describes well tools 20, 22, which can include a swellable material 44, with the swellable material 44 comprising a swellable glass material.

The swellable material 44 may be included in a swellable seal 24 of the well tool 20.

The well tool 20 can include a flow controller 40 which selectively prevents and permits contact between the swellable material 44 and a fluid 38 which causes the swellable material 44 to swell.

The swellable material 44 may be included in an actuator 30 of the well tool 22.

The swellable material 44 may be isolated from fluid 52 in a well by at least an outer layer material 46.

The swellable material 44 may be incorporated into a matrix material 50 of a swellable seal 24.

The well tool 20 can comprise a packer assembly 21.

The well tool 22 can comprise a flow control device 28.

The above disclosure also describes a method of actuating a well tool in a subterranean well. The method can include contacting a swellable material 44 of the well tool 20, 22 with an activating fluid 38 in the well, thereby causing the swellable material 44 to swell. The well tool 20, 22 actuates in response to contacting the swellable material 44 with the activating fluid 38. The swellable material 44 can swell rapidly upon contact with the fluid 38.

The method can also include the step of un-swelling the swellable material 44 in the well. The un-swelling step can be readily accomplished by various techniques.

The actuating step can include actuating a flow controller 40 which selectively prevents and permits contact between the swellable material 44 and the activating fluid 38.

The actuating step can include the packer assembly 21 sealing off an annulus 26 formed radially between the well tool 20 and a wellbore 14.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of this disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure.

Accordingly, the foregoing detailed description is to be clearly understood as being given by way of illustration and example only, the spirit and scope of the present invention being limited solely by the appended claims and their equivalents.

What is claimed is:

1. A method of actuating a well tool in a subterranean well, the method comprising:

contacting a swellable material of the well tool with an activating fluid in the well, thereby causing the swellable material to swell, wherein the swellable material comprises a swellable glass; and the well tool actuating in response to the contacting step, further comprising the step of un-swelling the swellable material in the well.

2. The method of claim 1, wherein the swellable material is included in a swellable seal of the well tool.

3. The method of claim 1, wherein the actuating step further comprises actuating a flow controller which selectively prevents and permits contact between the swellable material and the activating fluid.

4. The method of claim 1, wherein the swellable material is included in an actuator of the well tool.

5. The method of claim 1, wherein the swellable material is isolated from well fluid by at least an outer layer material.

6. The method of claim 1, wherein the swellable material is incorporated into a matrix material of a swellable seal.

7. The method of claim 1, wherein the well tool comprises a packer assembly.

8. The method of claim 7, wherein the actuating step further comprises the packer assembly sealing off an annulus formed radially between the well tool and a wellbore.

9. The method of claim 7, wherein the actuating step further comprises the packer assembly sealing off an annulus formed radially between a casing and a borehole.

10. The method of claim 1, wherein the well tool comprises a flow control device.

* * * * *